US005269719A

United States Patent [19]

Klawitter et al.

[11] Patent Number: 5,269,719

[45] Date of Patent: Dec. 14, 1993

[54] LIGHT SHOW MECHANISM

[75] Inventors: Ronald R. Klawitter, Franklin County; Jerrald Spencer, St. Louis County, both of Mo.

[73] Assignee: Handi-Pac, Inc., Hermann, Mo.

[21] Appl. No.: 817,334

[22] Filed: Jan. 6, 1992

[51] Int. Cl.[5] ..... A63H 33/26; A63H 33/22; F21V 21/30; G09F 13/30

[52] U.S. Cl. ..... 446/485; 446/242; 446/246; 40/444; 362/35

[58] Field of Search ..... 446/175, 219, 242, 246, 446/485, 438, 439; 40/442, 444; 362/35, 249, 806, 811

[56] References Cited

U.S. PATENT DOCUMENTS

| | | | |
|---|---|---|---|
| 1,108,190 | 8/1914 | Kunitz | 362/811 X |
| 1,313,848 | 8/1919 | Drummond . | |
| 1,960,618 | 8/1932 | Compare . | |
| 2,055,777 | 4/1935 | Shigley . | |
| 3,030,856 | 4/1962 | Jordan | 446/219 X |
| 3,760,176 | 9/1973 | Trop | 40/442 X |
| 4,641,947 | 8/1991 | Yuen et al. | 362/35 |
| 5,030,160 | 7/1991 | Klawitter | 446/242 |

FOREIGN PATENT DOCUMENTS

| | | | |
|---|---|---|---|
| 119522 | 10/1930 | Austria | 362/35 |
| 510043 | 4/1952 | Belgium | 362/35 |

*Primary Examiner*—Danton D. DeMille

*Attorney, Agent, or Firm*—Polster, Lieder, Woodruff & Lucchesi

[57] ABSTRACT

A light show mechanism is provided that includes light brackets which are mounted for rotation on opposite ends of a platform. The light brackets have at least two spaced lamps mounted thereon. The platform rotates about a central axis. As the platform rotates, the light brackets travel in a planetary path. The light brackets rotate on the platform as the platform rotates so that its lights sweep out aesthetically pleasing designs. The rate of rotation of the light brackets can be changed independently of each other to change the design formed by the lights.

12 Claims, 5 Drawing Sheets

LIGHT SHOW MECHANISM

BACKGROUND OF THE INVENTION

This invention relates to a light show apparatus. It has particularly application to a light show apparatus contained in a display box, but is not limited thereto.

Designs produced by spinning lights have always been of interest to children.

One object of this invention is to provide a simple but highly effective light display apparatus in which electrically operated lamps are rotated in such a way as to produce interesting and aesthetically pleasing designs.

Another object is to produce such an apparatus wherein the design produced by the lights can be changed by an operator.

Other objects will become apparent to those skilled in the art in light of the following description and accompanying drawings.

SUMMARY OF THE INVENTION

In accordance with this invention, generally stated, there is provided a light display apparatus that includes a platform having an axis of rotation, a mechanism for rotating the platform about its axis, light brackets rotatably mounted on the platform offset from the vertical axis of the platform, a mechanism for rotating the light brackets with respect to the platform, electric lamps mounted on the light brackets offset from the light brackets' axes, and a mechanism to vary the rate of rotation of the light brackets independently of the platform. In one embodiment, a first electric motor is used to rotate the platform. The platform has a stem which engages a shaft of the first motor to be rotated thereby.

There are preferably two light brackets which are spaced from each other and which are rotated by second and third electric motors. The second and third electric motors each has a rotating shaft, each operatively connected to one of the light brackets to rotate the light brackets.

In a first design of this embodiment, all three motors are mounted on a base. The second and third motors are operatively connected to gears on hollow sleeves, as with pinion gears, to rotate the sleeves. The sleeves in turn are operatively connected to the light brackets to rotate the light brackets. This connection may be made by gears or by pulleys and belts.

In a second design of this embodiment, each of the second and third motors is carried by the platform by a basket on the platform. Here, each bracket has a stem which engages the shaft of the motor to rotate the bracket. Because the second and third motors move in a circular pattern caused by the rotation of the platform, they cannot be wired directly to the source of electricity. Rather, brush arms and contacts are used to supply electricity to the motors. A jacket, placed around the first motor, having a first and a second conductive ring, is used to supply power to the motors. The two rings are connected to opposite poles of the source of electricity, i.e. one is connected to the positive and one is connected to the negative. In a first design, a first conductive arm is rotatably mounted about the first motor shaft. The arm has a brush which engages the first conductive ring and opposing end portions which are connected to first contacts of the second and third motors. Second conductive arms, there being one second arm mounted to the bottom of each of the baskets, have an ear connected to a second contact of the second and third motors and a brush in contact with the second conductive ring.

In another design, a first conductive arm having a brush in electrical contact with the first ring is electrically connected to a first contact of the second motor. A second conductive arm having brush means in electrical contact with the second ring is in electrical contact with a first contact of the third motor. Second contacts of the third motor are then placed in electrical communication by an electrical plate.

If the lamps are not directly connected to a battery, they must be supplied with a source of electricity. This may be done by placing the first motor shaft in communication with a first pole of the source of electricity and mounting a plate on the platform to be in electrical contact with the first motor shaft. The shafts of the second and third motors extend through the plate, and the plate is electrically insulated from these shafts. A first plate is mounted to the light bracket. It has brush arm in electrical contact with the platform plate and is electrically connected to a first lead of the electric lamp. This plate is electrically isolated from the second and third motor shafts. A second conductive plate is mounted to the light bracket so as to be electrically isolated from the first light bracket electric plate. The second light bracket plate is electrically connected to the second and third motor shafts and to second leads of the electric lamps. The shafts of the second and third motors are placed in electrical communication with the source of electricity to complete the circuit for the lamps.

In another embodiment, the platform and the light brackets are driven by a single motor. In this embodiment, the platform is a gear and meshes with a gear on the motor shaft to drive the platform. The brackets are driven by gears which are in frictional, but sliding, contact with each other, one of them being in frictional, but sliding, contact with the platform. In this manner, when the platform is rotated, the gears will rotate, hence the brackets will rotate.

When there are multiple motors, the rotational speed of the light brackets may be electrically controlled using a rheostat. Preferably there is a separate rheostat for each motor. The rheostats are operatively connected to levers, dials, or the like for operation by a user to control the rheostat and thus the speed of the brackets.

When there is only one motor, the speed of the brackets may be mechanically controlled. A mechanical braking system includes a yoke which surrounds the stem or sleeve of the gears that drive the light brackets. The yoke includes a shaft and a brake slidably mounted in the yoke. The sleeve is positioned in the yoke between the brake and the shaft. The brake is biased towards the sleeve and is movable between a sleeve braking position and a sleeve relieving position by selectively moving said shaft radially toward or away from said sleeve. The shaft is operatively connected to levers, dials, or the like to be moved by an operator.

In a third embodiment, the platform is hand or manually operated. In this embodiment, the platform is mounted on a shaft which is mounted in the center of a disc. The platform is rotated by a crank operatively connected to the platform by gears. The light brackets are rotated by sleeves which are rotatably journaled about the shaft and are operatively connected to the light brackets. The sleeves are caused to rotate about the shaft by a wheel which rotates on the disk. A gear is attached to the wheel by a shaft and engages a gear on the sleeve. As the disc rotates, the wheel will turn, causing the sleeve, and hence the light bracket, to rotate. To alter the speed of the brackets, the wheel is slidably mounted on its shaft and may be moved radially toward or away from the sleeve by a fork. The fork is operatively connected to a lever, dial or the like to move said wheel radially.

DESCRIPTION OF THE PREFERRED EMBODIMENT

Figure 1:
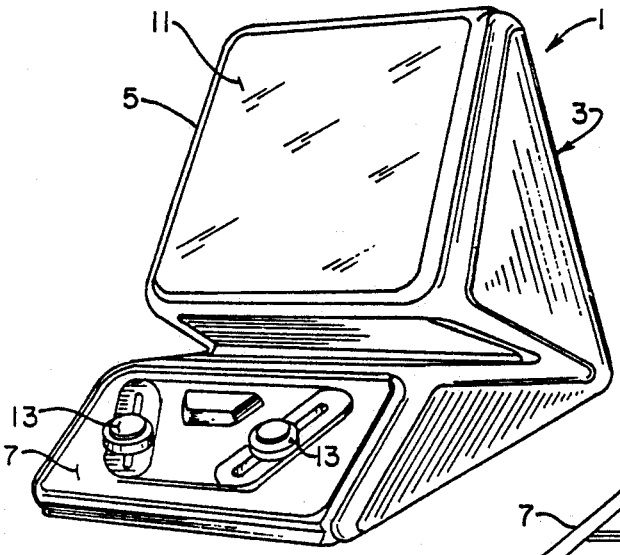
FIG. 1 is a perspective view of a light display box.
Figure 2:
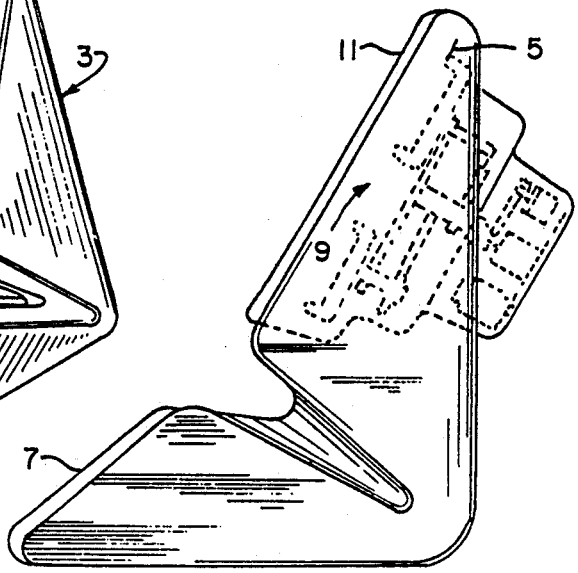
FIG. 2 is a side elevational view of the light display box with a light display mechanism shown in phantom therein.
Figure 10:
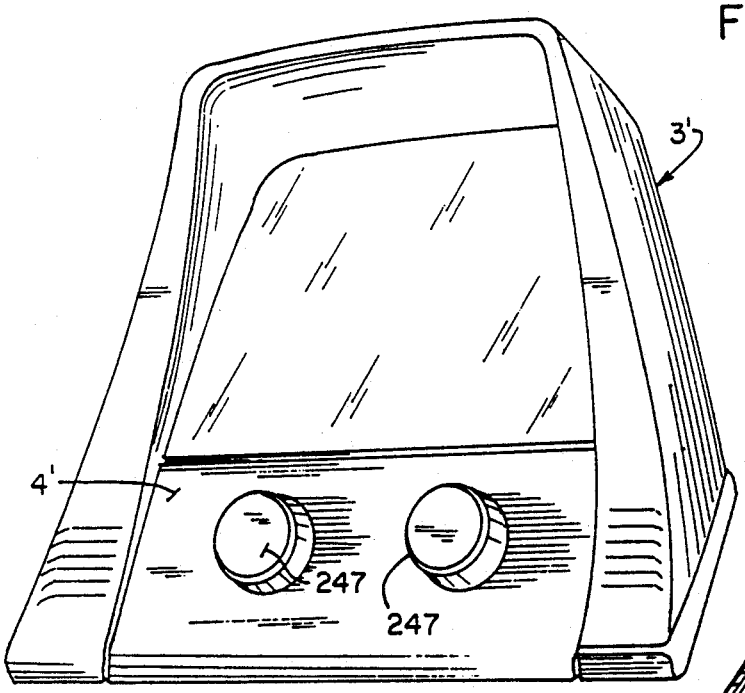
FIG. 10 is a front elevational view of the control box of FIGS. 8 and 11.
Figure 11:
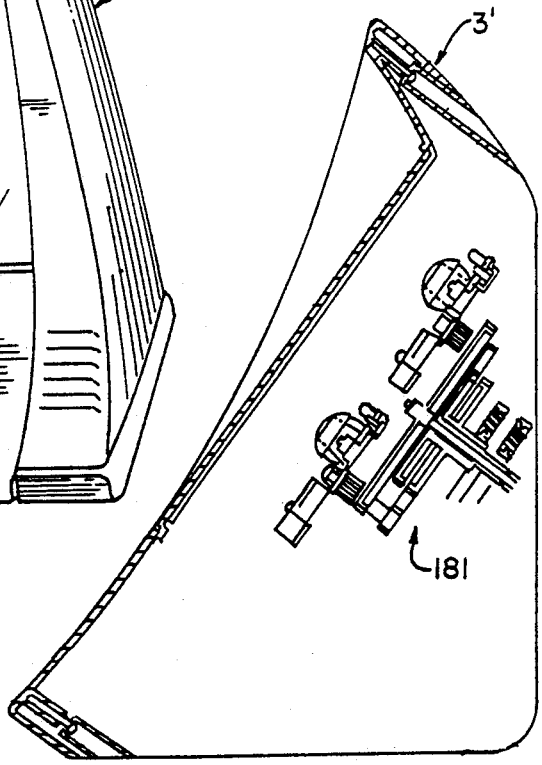
FIG. 11 is a cross-sectional view of the control box of FIG. 10 showing the light display apparatus of FIG. 7 therein.

Referring to FIGS. 1 and 2, reference numeral 1 generally refers to a light display toy. Toy 1 includes a display box 3 having a housing 5 and a control panel 7. A light mechanism 9 is contained in housing 5 and includes lamps offset from the center of housing 5 which travel in a circle in housing 5 and which rotate as they travel. This movement creates patterns which are visible through a screen 11. Control panel 7 includes levers 13, knobs, or the like which separately control the speed at which the lamps rotate as they travel about their path so that the design may be altered.

Figure 3:
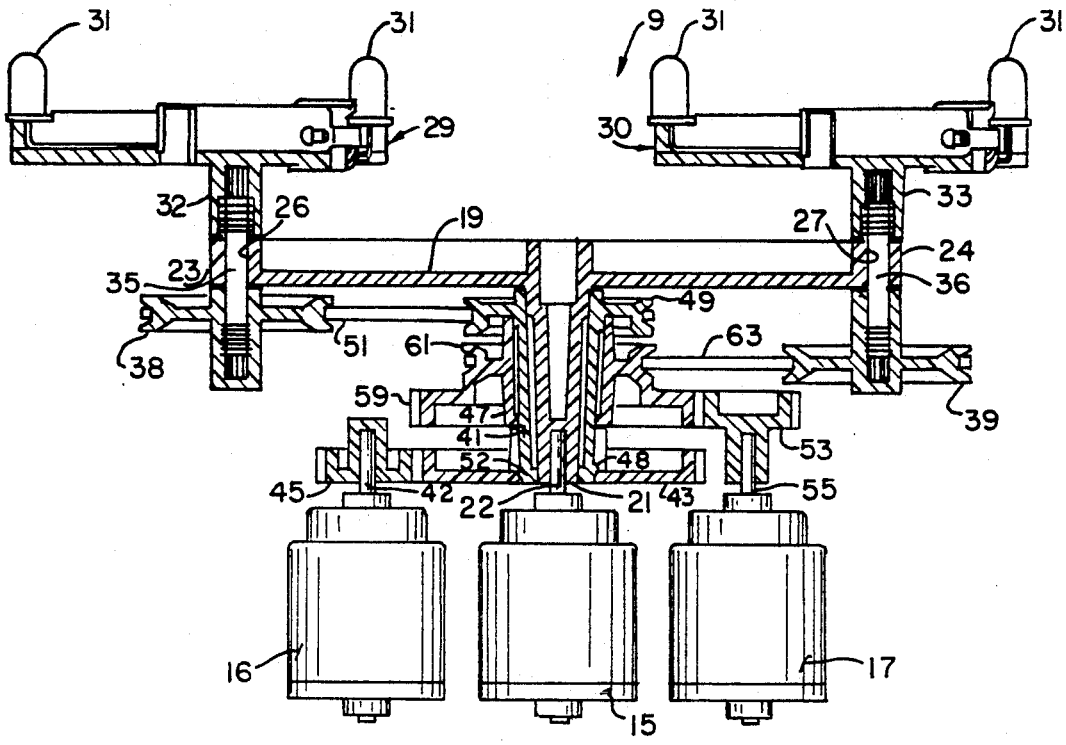
FIG. 3 is a cross-sectional view of the light display mechanism.

Light mechanism 9, shown in more detail in FIG. 3, is operated by three electric motors 15, 16, and 17. Mechanism 9 includes a platform 19 having a hollow stem 21 at its center. Stem 21 is fixed to shaft 22 of motor 15 so that platform 19 will rotate when motor 15 is operated. Bosses 23 and 24 are formed on opposite sides of platform 19 and have bores 26 and 27 there through.

Brackets 29 and 30 carrying electric lamps 31, preferably LED's, are mounted for rotation on platform 19. Brackets 29 and 30 each has a hollow stem 32 and 33 which is offset from the center of brackets 29 and 30. Shafts 35 and 36 are rotatably fixed in stem 32 and 33 and are rotatably journaled in bosses 23 and 24. Stems 32 and 33 extend through bosses 23 and 24 and have pulleys 38 and 39 rotatably fixed to the ends thereof. When pulleys 38 and 39 rotate, light brackets 29 and 30 rotate on platform 19.

A hollow sleeve 41 is journaled for rotation about platform stem 21. Sleeve 41 has a gear 43 at the bottom thereof and a pulley 49 at the top thereof. Gear 43 meshes with a gear 45 which is fixed to shaft 42 of motor 16. Pulley 49 is operatively connected to pulley 38 by a belt 51. Motor 16 thus drives pulley 38 to rotate light bracket 29. Gear 43 has a detent 48 which receives a ball 52 formed on sleeve 41 so that sleeve 41 rotates with gear 43. Gear 43 may be integrally formed on sleeve 41. Pulley 49 is formed integrally with sleeve 41 but may be separately secured thereto, as is gear 43.

Motor 17 has a gear 53 fixed to its shaft 55. A second sleeve 47 is journaled for rotation about sleeve 41. Sleeve 47 includes a gear 59 and a pulley 61. Gear 59 meshes with gear 53. Pulley 61 is operatively connected to pulley 39 by a belt 63. Motor 17 thus drives pulley 39 and hence rotates light bracket 30.

As can be seen, motor 15 causes light brackets 29 and 30 to travel on a planetary path around housing 5 and motors 16 and 17 rotate brackets 29 and 30, respectively, as they travel about their paths. Levers 13 are operatively connected to motors 16 and 17 so that their rotational speed can be varied, thereby allowing the design created by the traveling, rotating lights to be changed. Levers 13 can, for example, operate rheostats to change the speed of motors 16 and 17.

Figure 4:
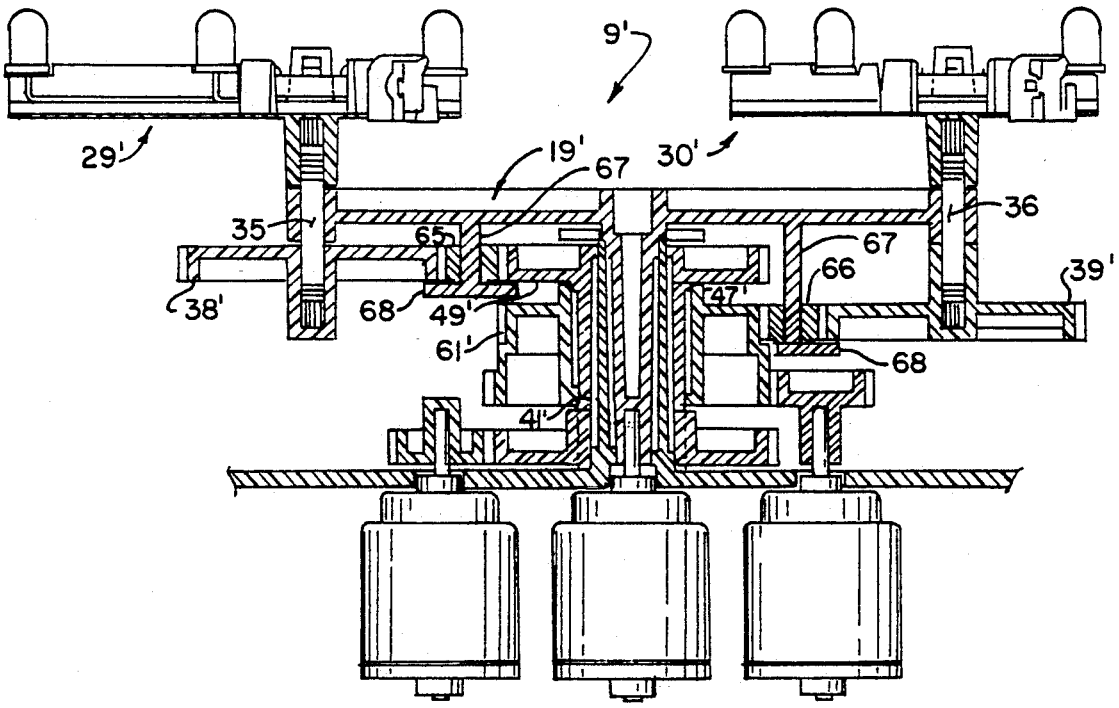
FIG. 4 is a cross-sectional view of the light display apparatus of FIG. 3 adapted to be operated with gears, rather than with pulleys an belts.

The embodiment shown in FIG. 4 is similar to that of FIG. 3. However, brackets 29' and 30' are driven by gears, rather the pulleys. Light bracket shafts 35 and 36 have gears 38' and 39' fixed to the bottoms thereof. Gear 38' meshes with a gear 49' of sleeve 41'. Sleeve 41' is driven by motor 16 in the same manner as sleeve 41. Gear 39' meshes with gear 61' of second sleeve 47'. Sleeve 47' is driven by motor 17 via gears 53 and 59. As shown in the drawing, gears 38' and 39' are not in direct meshing contact with gears 49' and 61', respectively. Rather, gears 65 and 66 operatively connect the gears. Gears 65 and 66 are rotatably journaled about stems 67 which depend from the bottom of platform 19'. Flat plates 68 at the bottom of stem 67 hold gears 65 and 66 to platform 19'.

Figures 5, 6:
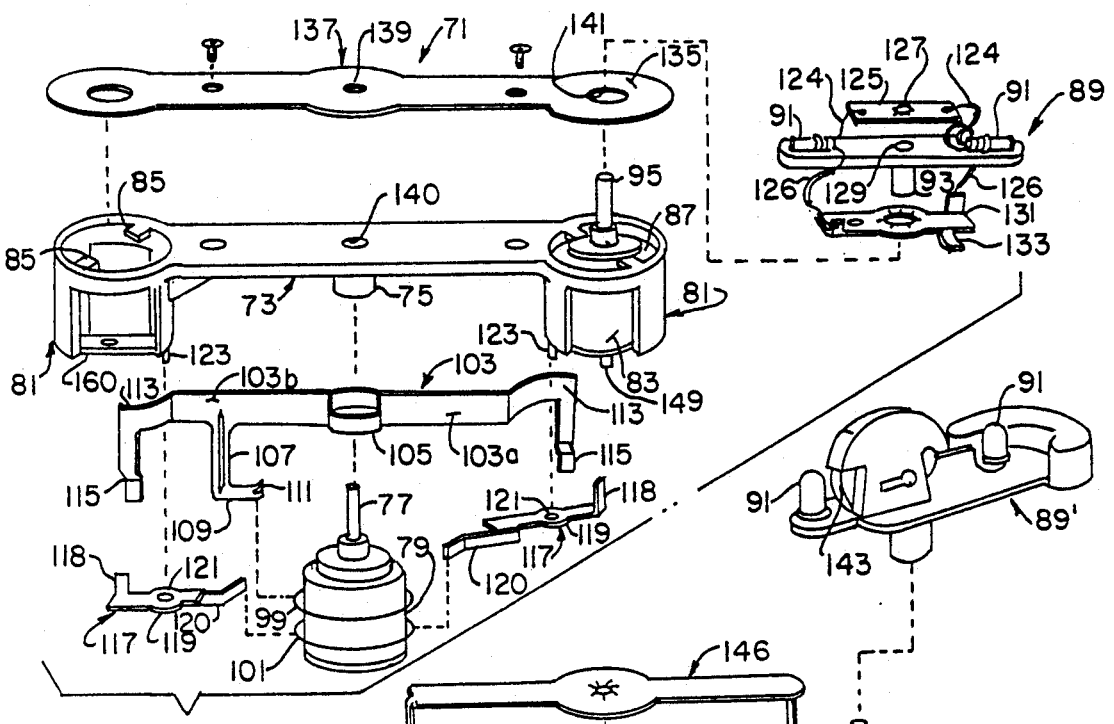
FIG. 5 is an exploded view of a second embodiment of the light display apparatus wherein a rotatable platform carries motors which rotate light brackets.
FIG. 6 is an exploded view of a display apparatus similar to FIG. 5, but using a different design to supply electricity to the motors which rotate lights.
Figure 7:
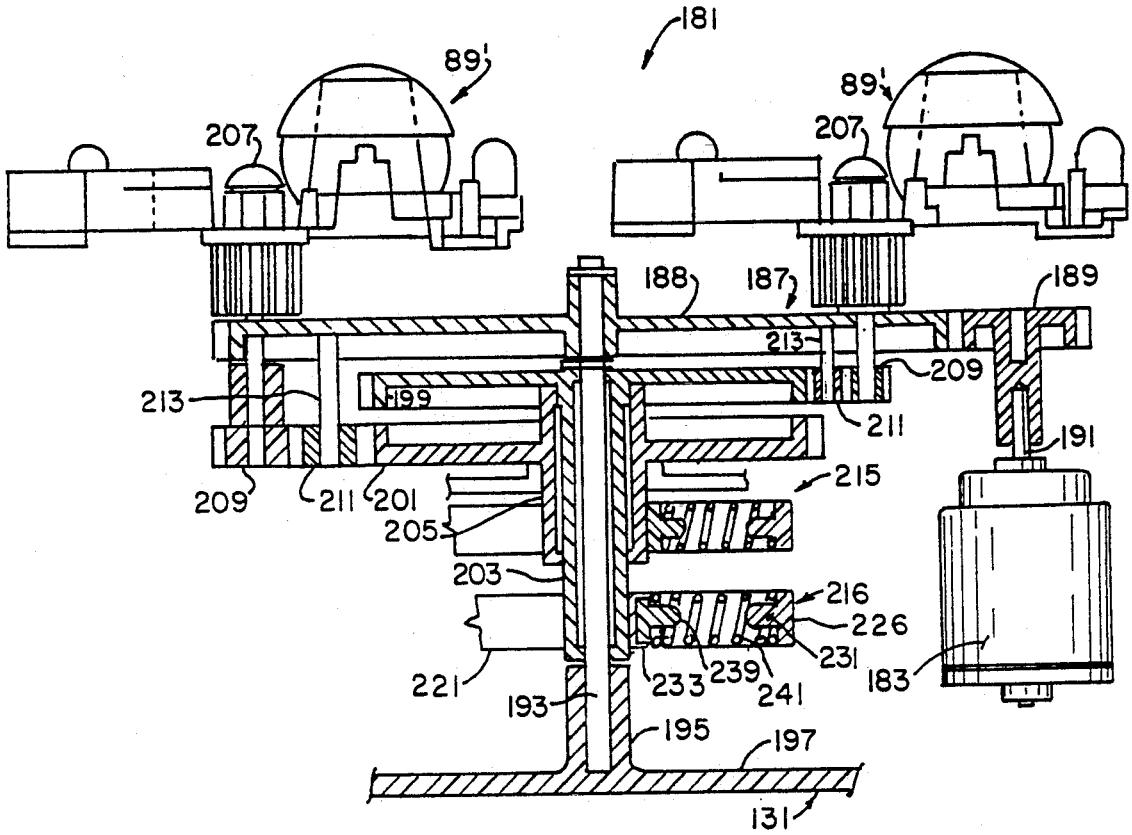
FIG. 7 is a third embodiment of the light display apparatus using only one motor to operate the mechanism.

Referring to FIG. 5, reference numeral 71 refers to a second embodiment of the light display mechanism. Display mechanism 71 includes a platform 73 made of a non-conductive material having a hollow stem 75 at its center. Stem 75 fits over and is secured to a shaft 77 of an electric motor 79. Platform 73 also has two baskets 81 positioned at opposite sides of the platform, each of which carries an electric motor 83 (only one of which is shown). Brackets 81 each have fingers 85 at the tops thereof which engage shoulders 87 of motors 83 to hold motors 83 in the baskets. A light bracket 89 carrying electric lamps 91 has a downwardly extending hollow stem 93 which is fixedly secured to the shaft 95 of motor 83 to be driven by motor 83. There are two light brackets 89, only one of which is shown.

Motors 83 travel with platform 73 and thus cannot be directly connected to a source of electricity by wires. Instead, motor 79 is fitted with a non-conductive jacket 97 having spaced conductive rings 99 and 101. Jacket 97 is best shown in FIG. 6, and is shown only schematically in FIG. 5. As is standard in small electric motors, motors 79 and 83 have contacts 149 which connect the motor to a battery or other source of electricity. Contacts 149 are exposed and accessible. Rings 99 and 101 are in electrical communication with the contacts of motors 83. A conductive arm 103 has a center ring 105 sized to fit around platform stem 75 and a downwardly extending arm 107 having a brush 109 with a slit 111. Arm 107 and brush 109 are sized so that slit 111 contacts and slides on first ring 99. Arms 103*a,b* of arm 103 each have curved portions 113 with tabs 115 which engage, and are secured to, one of the contacts of motors 83.

Second arms 117 are connected to the other contact of motors 83 by a tab or ear 118 and have brushes 120 which extend inwardly to contact and slide on second ring 101. Arms 117 have circular portions 119 which have a bore 121 there through. Bores 121 fit about pins 123 which depend from baskets 81. Basket pins 123 are headed, as is known in the art, to hold arms 117 in place.

The lamps 91 are not directly connected to a battery or other source of electricity and thus must be in electrical communication with the source of power which operates light display mechanism 71. Lamps 91 have one lead 124 which connects them to a conductive plate 125 secured to the top of light bracket 89. Plate 125 has a center hole 127 positioned over a bore 129 in stem 93. Shaft 95 of motor 83 extends through bore 129 and the edge of hole 127 fits snugly around shaft 95 so that plate 125 is in contact with shaft 95. Shaft 95 is made of conductive material and is in electrical communication with the first contact of motor 83 which in turn is in electrical communication with first ring 99 of motor jacket 97.

A second lead 126 of lamp 91 is electrically connected to a second plate 131 secured to the bottom of light bracket 89. Plate 131 is secured to bracket 89 around stem 93 and is thus electrically isolated from motor shaft 95. Plate 131 has a brush 133 which sweeps around a circular portion 135 of a conductive plate 137. Plate 137 is secured to the top of platform 73 and has a hole 141 through which light bracket stem 93 extends. Stem 93 electrically isolates plate 137 from motor shaft 95. Plate 137 has a hole 139 at its center, the edges of which are in contact With shaft 77 of motor 79. Shaft 77 extends through a bore 140 in stem 75, and shaft 77, in turn, is in electrical communication with the second ring 101 of motor jacket 97. The electrical circuit to lights 91 thus follows a path including the first contact of motor 79, ring 99 of jacket 97, brush 111 of arm 103, the first contact of motor 83, motor shaft 95, plate 125, light 91, plate 131, plate 137, motor shaft 77, second ring 101 of jacket 97, and the second contact of motor 83.

In FIG. 6, the light bracket 89 of FIG. 5 is replaced with light bracket 89'. This light bracket is the same as is set forth in my patent, U.S. Pat. No. 5,030,160, which is incorporated herein by reference. The lamps 91 on the bracket are powered by a battery 143 and thus do not have to be connected to the source of power which operates motor 79. The connection of motor 83 can thus be made more easily. In this embodiment, platform 73' has channels 145 adjacent baskets 81. A conductive plate 146, placed on top of platform 73', has arms 147 which are connected to contact 149*b* of motor 83*a* to contact 149*a* of motor 83*b*, to electrically connect motors 83*a* and 83*b*. A brush arm 151*a* is connected to contact 149*a* of motor 83*a*. It has a brush 153 which slidably contacts ring 101 of jacket 97. A second brush arm 151*b* is connected to contact 149*b* of motor 83*b* and is in sliding electrical contact with jacket ring 99 by its brush 153. Brush arms 151*a*, 151*b* each has a disc 155 defining a hole 157. Pins or rivets 159 entered through disc holes 157 to secure arms 151*a*, 151*b* to the bottoms 110 of baskets 81 (shown best in FIG. 5).

The connection of rings 99 and 101 to a source of power 159 can be seen at the bottom of FIG. 6. As shown, ring 101 is connected to a first rheostat 161 which in turn is connected to a positive pole 163 of battery 159. Ring 99 is connected to a second rheostat 165 which is also connected to positive pole 163. The negative pole 167 is connected to the bottom of motor 79 by a wire 169. An eyelet 171 at the end of wire 169 is connected to the motor 79, using a rivet 173. A switch 175 is placed intermediate the ends of wire 169 to start and stop mechanism 71'. Rheostats 161 and 165 serve to vary the speed of motors 83, but do not affect the speed of motor 79.

FIGS. 7–11 show another embodiment wherein a light display mechanism 181 is operated by a single motor 183. In mechanism 181, light brackets 89' are rotatably mounted on the top surface 185 of a gear 187. The teeth of gear 187 mesh with the teeth of a pinion gear 189 which is fixed to shaft 191 of motor 183. Motor 183 thus drives gear 187 and light brackets 89'.

Gear 187 is rotatably secured to the upper end of a shaft 193 which is secured in a boss 195 on the back 197 of box 3'. Two gears 199 and 201 having hollow stems 203 and 205, respectively, are rotatably mounted on shaft 193 beneath gear 187. Stem 203 of gear 199 is longer than gear stem 205 and is rotatably journaled therein. Thus gear 199 rotates around shaft 193 and gear 201 rotates around stem 203 of gear 199. The top surface of gear 199 is in frictional contact with the stem of gear 187 and gears 199 and 201 frictionally contact each other. Thus when motor 183 drives gear 187, gears 199 and 201 will also rotate.

A screw 207 extends through each light bracket 89' and is fixed in gear 209 beneath gear 187. Gears 209 in turn mesh with gears 211 which are rotatably connected to the underside of gear 187 by shafts 213. One of the gears 211 is in meshing contact with gear 199 and the other is in meshing contact with gear 201 to cause brackets 89' to rotate as they travel around the path defined by the rotation of gear 187.

Figures 8, 9:
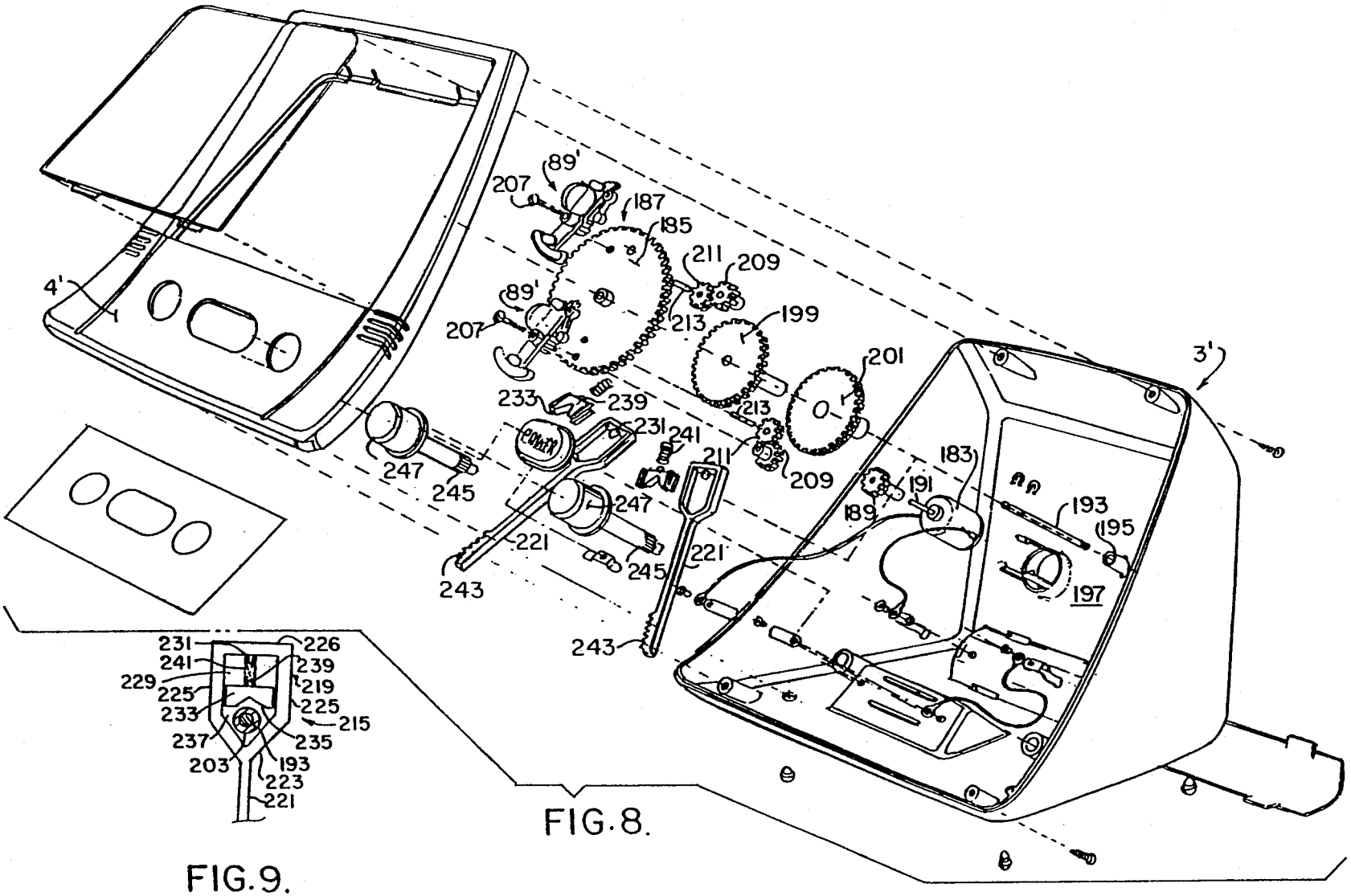
FIG. 8 is an exploded view of the light display apparatus of FIG. 7 in a control box.
FIG. 9 is an enlarged plan view, partly in cross-section, of a braking assembly of the embodiment of FIG. 7.

The speed of rotation of gears 199 and 201 and hence light brackets 89', is controlled by brake assemblies 215 and 216. Brake assembly 215 is best shown in FIG. 9. Brake assemblies 215 and 216 each includes a yoke strap 219 mounted on a shaft 221. The yoke strap 219 includes a "Y" section 223, two parallel side walls 225 and a back wall 226 extending between the ends of side walls 225 opposite the "Y" section. Walls 225 and 226 define an enclosed area 229. Back wall 226 has a inwardly extending finger 231 in the middle thereof. A rectangular brake block 233 having a "V" notch 235 is mounted axially to slide between side walls 225 in hollow area 229. The notch 235 faces the inner surface of the "Y" section 223 to form a diamond shaped area 237. Opposite the "V" notch 235, the brake block 233 has a finger 239 which faces finger 231 of back wall 226. A compression spring 241 is received on fingers 231 and 239 to bias brake block 233 toward "Y" section 223.

The stems 203 and 205 are received in the diamond shaped areas 237 of brake assemblies 215 and 216, respectively. By pulling the yoke strap, hence the back wall 226 of terminal end 219 forward, brake block 233 is urged against the gear stem to slow the rotation of the gear and hence its associated light bracket. The provision of the spring 241 prevents damage to the gear stem and permits better control of the braking force. The forward end of brake assembly shaft 221 is toothed, as at 243. Teeth 243 mesh with a gear 245 which is rotated by knobs 247 accessible on control panel 4'. By rotating knobs 247, arms 22 of brakes 215 and 216 are moved to vary the pressure exerted on shafts 203 and 205 of gears 199 and 201, to vary the speed of gears 199 and 201. Although gears 187, 199 and 201 are in frictional contact with each other, there is slippage between them. Thus, a change in the rotational velocity of one gear will not greatly effect the rotational rate of the other gears.

Figure 12:
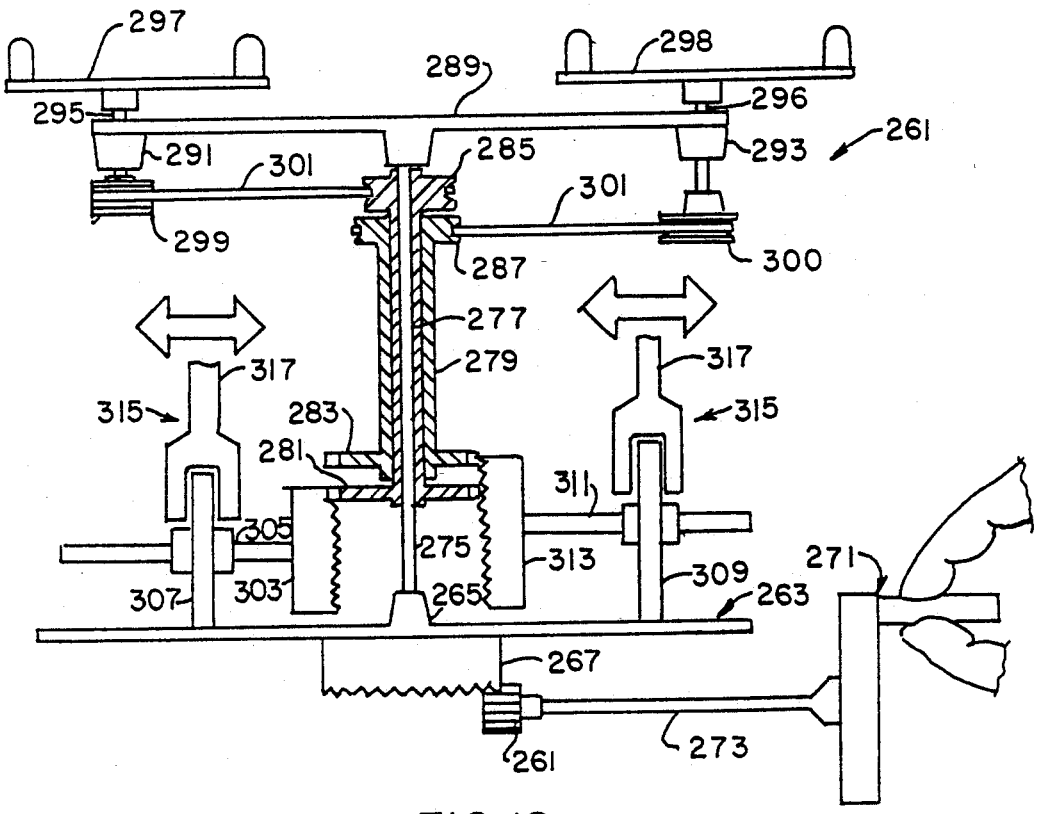
FIG. 12 is an elevational view, partly in cross-section, of another embodiment of the light display apparatus which is hand operated.

Turning to FIG. 12, a hand operated light display mechanism is indicated to by reference numeral 261. Mechanism 261 includes a disc 263 having a centered upwardly extending boss 265 on its upper surface and a gear 267 centered on its lower surface. Gear 267 meshes with a pinion gear 261 which is connected to a hand crank 271 by a shaft 273. Operation of the crank thus rotates disc 263.

A shaft 275 is fixed in boss 265. A first sleeve 277 is rotatably journaled on shaft 275 and a second sleeve 279 is rotatably journaled on sleeve 277. Sleeves 277 and 279 have a gear 281 and 283, respectively, at the bottoms thereof, and a pulley 285 and 287, respectively, at the tops thereof. Sleeve 279 is shorter than sleeve 277 and fits between gear 281 and pulley 285. Shaft 275 extends beyond sleeve 277 and has a platform 289 fixed to the top thereof. Platform 289 rotates with disc 263.

Platform 289 has journal boxes 291 and 293 formed on opposite sides thereof. Shafts 295, 296 of light brackets 297, 298 are journaled there through so that light brackets 297, 298 rotate on platform 289. Pulleys 299 and 300 are fixed to the bottoms of shafts 295 and 296, respectively. Pulleys 299 and 300 are connected to pulleys 285 and 287, respectively, by belts 301. Thus rotation of sleeve 277 will cause light bracket 297 to rotate on platform 299 and rotation of sleeve 279 will rotate light bracket 298.

A gear 303 having a square spline shaft 305 meshes with gear 281. A rubber wheel 307 is mounted on shaft 305 and rolls on disc 263. When disc 263 rotates, wheel 307 rolls, rotating gear 303, and hence sleeve 277 and light bracket 297. Similarly, a wheel 309 mounted on a square spline shaft 211 connected to a gear 313 which meshes with gear 283 operates sleeve 295 to rotate light bracket 298.

Wheels 307 and 309 are slidable on shafts 305 and 311 and may be moved using forks 317. By moving wheels 307 and 309 toward or away from shaft 275, the rotational rate of gears 303 and 313 is changed, thereby changing the rotational speed of light brackets 297 and 298. Forks 315 on shafts 317 embrace wheels 307 and 309. Shafts 317 are connected to knobs which move the forks independently radially inwardly or outwardly, thereby moving wheels 307 and 309 to change the speed of light brackets 297 and 298.

Numerous variations, within the scope of the appended claims, will be apparent to those skilled in the art in light of the foregoing description and accompanying drawings. Merely by way of illustration various combinations of elements from the different embodiment described can be utilized. The electric lamps of the embodiments described can be replaced in whole or part by reflectors. These are merely illustrative.

Having thus described the invention, what is claimed and desired to be secured by Letters Patent is:

1. A light display apparatus comprising:

a platform having an axis of rotation;

a disc and a shaft mounted in the center of said disc, said platform being fixed to said shaft;

means for rotating said platform about its axis;

light bracket means rotatably mounted on said platform offset from said axis of rotation;

means for rotating said light bracket means with respect to said platform comprising a crank operatively connected to said disc to rotate said disc and said platform;

light means mounted on said light bracket means offset from said light bracket means axis; and mechanical means for varying the rate of rotation of said light bracket means independently of said platform.

2. The apparatus of claim 1 wherein said light bracket rotating means comprises a sleeve rotatably journaled about said shaft and means for rotating said sleeve, said sleeve being operatively connected to said light bracket to rotate said light brackets.

3. The apparatus of claim 2 wherein said sleeve rotating means comprises a wheel on said platform which rotates as said disc rotates and a gear operatively connected to said wheel to rotate as said wheel rotates; said sleeve having a gear which is operatively connected to said wheel gear.

4. The apparatus of claim 3 wherein a shaft connects said wheel and said wheel gear; said light bracket rotation varying means comprising means for radially sliding said wheel on said shaft towards and away from said gear.

5. The apparatus of claim 4 wherein said wheel sliding means comprises a fork embracing a portion of said wheel, said fork being operatively connected to a lever, dial or the like to radially move said wheel.

6. A light display apparatus comprising:

a platform rotatably mounted to a shaft and having an axis of rotation, said platform having a toothed periphery;

means for rotating said platform about its axis comprising an electrical motor having a shaft and a gear mounted on said shaft, said gear being operatively connected to said platform teeth;

light bracket means rotatably mounted on said platform offset from said axis of rotation;

means for rotating said light bracket means with respect to said platform comprising a sleeve rotatably journaled about said shaft, said sleeve having a gear, said light bracket being operatively connected to a gear, said sleeve gear and said light bracket gear being in operative communication with each other, said sleeve gear being in sliding frictional contact with said platform to be rotated by said platform;

light means mounted on said light bracket means offset from said light bracket means axis; and mechanical brake means for varying the rate of rotation of said light bracket means independently of said platform.

7. The apparatus of claim 6 wherein said mechanical brake means comprises a yoke which surrounds said sleeve, said yoke comprising a shaft and a brake slidably mounted in said yoke, said sleeve being between said brake and said shaft, said brake being biased towards said sleeve, said brake being movable between a sleeve braking position and a sleeve rotation position by selectively moving said shaft radially toward or away from said sleeve, said shaft being operatively connected means in the form of levers, dials, or the like to be moved by an operator.

8. A light display apparatus comprising:

a platform having an axis of rotation;

means for rotating said platform about its axis comprising a first motor having a rotating shaft, said platform having a stem which engages said motor shaft to rotate said platform;

light bracket means comprising two spaced apart light brackets rotatably mounted on said platform offset from said axis of rotation;

means for rotating said light bracket means with respect to said platform comprising second and third electrical motors having rotating shafts, each said light bracket being operatively connected to one of said second and third motor shafts to be rotated thereby;

light means mounted on said light bracket means offset from said light bracket means axis;

manual means to vary the rate of rotation of said light brackets independently of said platform;

first and second spaced brackets carried by said platform, said first and second baskets carrying said second and third motors, respectively; said first and second light brackets each including a hollow stem which is rotatably fixed to said first and second motor shafts to be rotated thereby; and means for supplying electrical power to said first and second electrical motors comprising a jacket around said first motor, said jacket having a first and a second conductive ring connected to opposite poles of a source of electricity; a first conductive arm having brush means in electrical contact with said first ring and being electrically connected to a first contact of said second motor; a second conductive arm having brush means in electrical contact with said second ring and being in electrical contact with a first contact of said second and third motors in electrical communication with each other.

9. The apparatus of claim 8 wherein said light means are electric lamp means and said electrical lamp means are battery operated.

10. A light display apparatus comprising:

a platform having an axis of rotation;

means for rotating said platform about its axis comprising a first motor having a rotating shaft, said platform having a stem which engages said motor shaft to rotate said platform;

light bracket means comprising two spaced apart light brackets rotatably mounted on said platform offset from said axis of rotation;

means for rotating said light bracket means with respect to said platform comprising second and third electrical motors having rotating shafts, each said light bracket being operatively connected to one of said second and third motor shafts to be rotated thereby;

light means mounted on said light bracket means offset from said light bracket means axis;

manual means to vary the rate of rotation of said light brackets independently of said platform;

first and second spaced baskets carried by said platform, said first and second baskets carrying said second and third motors, respectively; said first and second light brackets each including a hollow stem which is rotatably fixed to said first and second motor shafts to be rotated thereby; and means for supplying electrical power to said first and second electrical motors comprising a jacket having a first and a second conductive ring, said rings being connected to a source of electricity, said jacket being placed about said first motor; a first conductive arm rotatably mounted about said first motor shaft having brush means which engages said first conductive ring and opposing end portions which are connected to first contacts of said second and third motors; and a second conductive arm for each of the second and third motors; said second conductive arms each having an ear connected to a second contact of said second and third motors and brush means in contact with said second conductive ring.

11. The apparatus of claim 10 wherein said light means comprises electric lamp means and, further including means for supplying electricity to said electric lamp means on said light brackets.

12. The apparatus of claim 11 wherein said electricity supplying means comprises means for placing said first motor shaft in communication with a first pole of said source of electricity, said first conductive arm being electrically isolated from said first motor shaft; a plate mounted on said platform to be in electrical contact with said first motor shaft, said plate defining opposing openings through which said second and third motor shafts extend, said plate being electrically isolated from said second and third motor shafts; a first plate mounted to said light brackets and having brush means in electrical contact with said platform plate, said first light bracket plate being electrically connected to a first lead of said electric light means and being electrically isolated from said second and third motor shafts; a second conductive plate mounted to said light brackets, said second light bracket plate being electrically connected to said second and third motor shafts and to second leads of said electric lamp means and electrically isolated from said first bracket plate; and means for placing said second and third motor shaft in communication with a second pole of said source of electricity; said shaft of said first, second, and third motors being made of an electrically conductive material.

* * * * *